United States Patent [19]

Demuth

[11] 4,193,428

[45] Mar. 18, 1980

[54] LOOM HAVING AN ADJUSTABLE DEFLECTION BEAM

[75] Inventor: Hans Demuth, Winterthur, Switzerland

[73] Assignee: Sulzer Brothers Ltd., Winterthur, Switzerland

[21] Appl. No.: 882,114

[22] Filed: Feb. 28, 1978

[30] Foreign Application Priority Data

Mar. 9, 1977 [CH] Switzerland ..... 2933/77

[51] Int. Cl.[2] ..... D03D 49/22

[52] U.S. Cl. ..... 139/114

[58] Field of Search ..... 139/97, 100, 109, 110, 139/114, 115; 66/86 A

[56] References Cited

U.S. PATENT DOCUMENTS

| | | | |
|---|---|---|---|
| 1,704,911 | 3/1929 | Burnham | 139/110 |
| 1,749,120 | 3/1930 | Baker | 139/110 |
| 1,783,779 | 12/1930 | Draper | 139/110 |
| 2,661,774 | 12/1953 | Kretzschmar | 139/114 |
| 3,495,631 | 2/1970 | Sakamoto | 139/97 |

FOREIGN PATENT DOCUMENTS

| | | | |
|---|---|---|---|
| 643938 | 8/1962 | Italy | 139/110 |

*Primary Examiner*—Henry Jaudon
*Attorney, Agent, or Firm*—Kenyon & Kenyon

[57] ABSTRACT

The deflection beam is mounted independently of the tensioning beam to permit raising and lowering of the deflection beam when mounting a warp beam on the loom. The deflection beam is mounted on a support which is secured to a support beam via a detachable clamp connection. A pivotally mounted roller lever which rides on a cam track on the support is used for raising and lowering the support and deflection beam.

11 Claims, 2 Drawing Figures

LOOM HAVING AN ADJUSTABLE DEFLECTION BEAM

Figure 1:
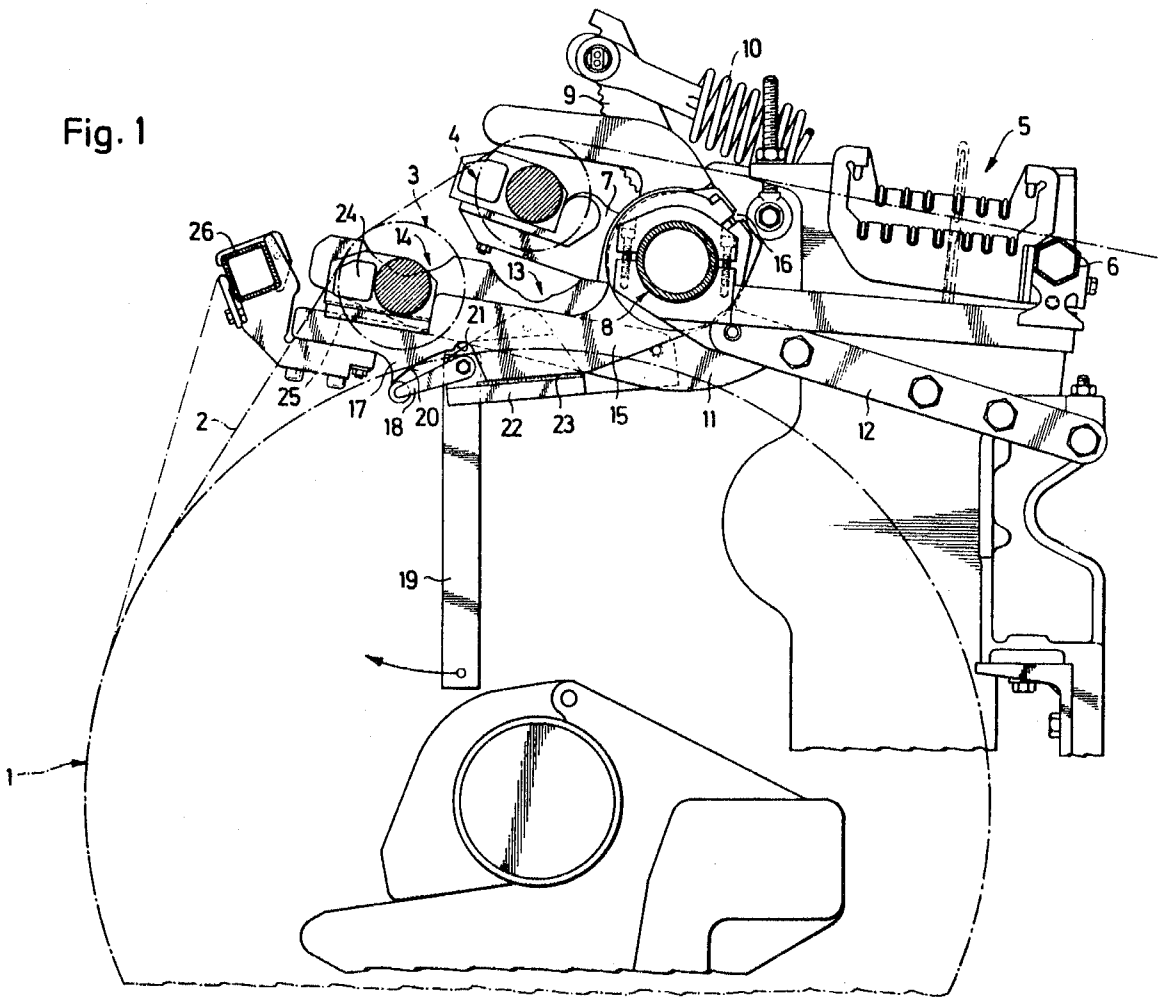

This invention relates to a loom and, more particularly, to a loom having a deflection beam for warp threads.

As is known, looms are frequently constructed with a tensioning assembly at a warp end which is capable of imparting a tension in the warp threads delivered from a warp beam to a shed. Generally, such tensioning assemblies employ a resiliently mounted tensioning beam to maintain a substantially constant tension in the warp threads.

When manufacturing heavy fabrics on looms, particularly looms having a large nominal width, such as 130 inches (330 centimeters), it has been advantageous for the warp threads to be deflected between the warp beam and the shed not only at the tensioning beam but also at one or several deflection beams. Depending on the arrangement of the deflection beam, the warp thread forces acting on the tensioning beam can be substantially reduced. This allows the use of a relatively light tensioning beam in the loom.

Generally, the tensioning beam and the warp threads are situated as low as possible in the loom for operating reasons, particularly for the repair of a warp thread break. Also, the diameter of the warp beam is chosen to be as large as possible in order to increase the operating efficiency of the loom. That is, the larger the warped beam, the more cloth or fabric can be woven for a given run. However, if the deflection beam is in a low position, this interferes with the assembly and disassembly of the warp beam, particularly, if the deflection beam is located below the outermost contour of the warp beam in the horizontal direction. In such a case, the warp beam can only be rolled in or out of the loom if the deflection beam is lifted away.

In one known loom, a deflection beam has been secured together with a support beam for a tensioning beam on a common adjustable support arm. Accordingly, when the deflection beam requires lifting, it is necessary to lift the entire assembly consisting of the deflection beam, tensioning beam and support beam with the support arm. This not only requires much power but also is accompanied by an undesirable change in the height of the tensioning beam.

Accordingly, it is an object of the invention to reduce the energy required for raising a deflection beam in a loom.

It is another object of the invention to allow lifting of a deflection beam without changing the position of a tensioning beam in a loom.

It is another object of the invention to reduce the energy required for making a warp beam change in a loom.

It is another object of the invention to simplify the mounting of a warp beam in a loom.

Briefly, the invention provides a loom with a deflection beam which is adjustably mounted relative to a tensioning beam i.e. the deflection beam can be raised and lowered independently of the tensioning beam.

In the case of a loom having a frame with suitable means for mounting a warp beam at one end, a tensioning beam is mounted on the frame for imparting tension to a plurality of warp threads passing from the warp beam and a deflection beam is mounted on the frame upstream of the tensioning beam relative to the warp threads passing from the warped beam. In addition, means are provided for adjusting the deflection beam relative to the tensioning beam. In this construction, the tensioning beam and deflection beam may be mounted in common on a support arm. In this case, the tensioning beam is secured to the support beam while the means for adjusting the deflection beam includes a support for the deflection beam which is secured to the support beam for selective rotation via a detachable clamp connection. The support, which may have a fulcrum coincident with the axis of the support beam, is provided with a cam track on an undersurface and cooperates with a movably mounted roller lever which is able to move along the cam track to raise and lower the support relative to the support arm. The cam track is formed by a curved surface which is shaped to allow a constant torque on the roller lever during raising and lowering of the support.

When a warp beam is to be mounted on the loom, the roller lever is pivoted to effect a raising of the support and the tensioning beam. The warp beam can then be rolled into the loom, and after placement, the tensioning beam and support are allowed to pivot back into an operating position.

Figure 2:
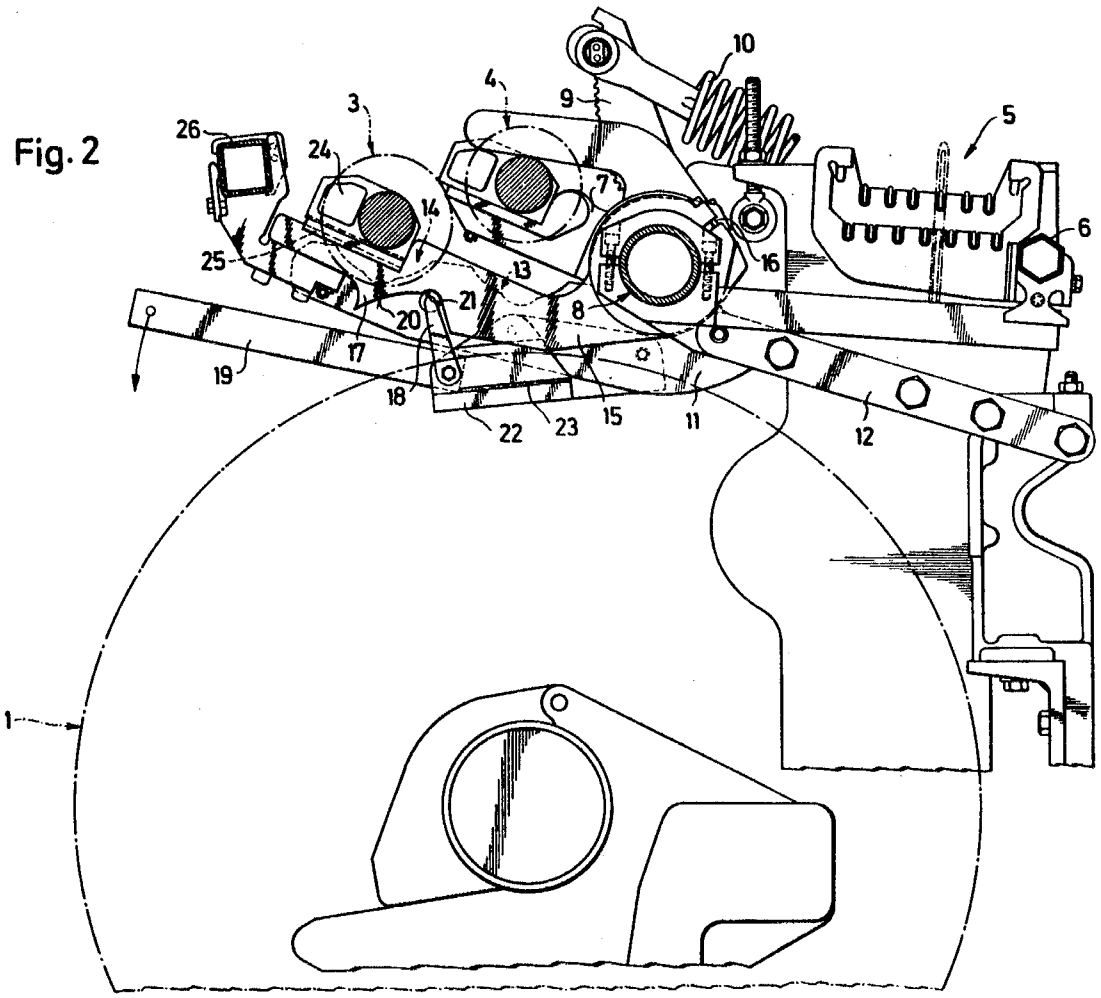

These and other objects and advantages of the invention will become more apparent from the following detailed description taken in conjunction with the accompanying drawings wherein:

FIG. 1 illustrates a diagramatic view of a warp beam portion of a loom with a deflection beam being in an operating position in accordance with the invention; and FIG. 2 illustrates a view similar to FIG. 1 of a loom with the deflection beam in a raised position.

Referring to FIG. 1, the loom is of generally known construction and need not be described in detail. For example, the loom employs a frame having suitable means for mounting a warp beam 1 thereon as well as a warp stop motion 5 which is mounted on the frame via a support tube 6.

The loom is provided with a tensioning beam 4 which is mounted on the frame for imparting tension to a plurality of warp threads 2 passing from the warp beam 1 to the warp stop motion 5. As shown, the tensioning beam 4 is mounted above the axis of the warp beam 1 between the warp beam 1 and the stop motion 5 by means of a mounting 7 which is rotatably fastened to a support beam 8. The support beam 8, in turn, rests on a support arm 11. The tensioning spring action of the tensioning beam 4 is provided by a tension spring 10 linked to a lever 9 in known fashion. The support arm 11 together with the tension spring 10 can swivel about a fulcrum (not shown) and can be fixed in different positions by an adjustable support 12. The support arm 11 is also provided with depressions 13, 14 to hold the support beam 8 in different positions.

The loom is also provided with a deflection beam 3 which is mounted on the loom frame upstream of the tensioning beam 4 relative to the warp threads 2 passing from the warp beam 1. As shown, the deflection beam 3 is mounted above the axis of the warp beam 1 between the warp beam 1 and the tensioning beam 4 in order to deflect the warp threads 2.

A means is also provided on the frame for moving the deflection beam 3 to adjust the deflection beam 3 independently relative to the tensioning beam 4 in order to permit raising of the deflection beam 3 away from the axis of the warp beam 1 without raising the tensioning beam 4. For this purpose, the adjustment means includes a support 15 secured to the support beam 8 via a detachable clamp connection 16 for selective rotation relative to the support beam 8. As indicated, the deflection beam 3 is mounted at one end of the support 15 while the support 15 has a fulcrum coincident with the axis of the support beam 8. It is to be understood that the fulcrum of the support 15 need not coincide with the axis of the support beam 8 but may be fastened at another point of the support arm 11.

The adjustment means also employs a pressure or cam track 17 on the underside of the support 15 which cooperates with a roller lever 18 which is pivotally mounted on a fixed axis relative to the support 15. In addition, an elongated lever 19 is secured to the roller lever 18 for pivoting of the roller lever 18 to selectively raise and lower the support 15 and the deflection beam 3 thereon.

The cam track 17 has a curved surface 20 with a detent 21. The surface 20 is shaped to allow a constant torque on the roller lever 18 during raising and lowering of the support 15.

A support member 22 is bolted to the support arm 11 to act as a rest for the support 15. In addition, an intermediate layer 23 of plastic is disposed between the support member 22 and the support 15. The deflection beam 3 is similarly mounted via a bearing block 24 on the support 15 with the interposition of a plastic layer or plate 25.

As shown in FIG. 1, the loom is also provided with a connecting bar 26 which serves to take-up excess warp threads as is known.

During operation of the loom (FIG. 1), the support 15 is clamped tightly to the support beam 8 by means of the clamp connection 16. The support 15 with the deflection beam 3 is thus in a lowermost or operating position. If the deflection beam 3 is to be raised, for instance in order to roll the warp beam 1 out of the loom frame, the clamp connection 16 is loosened and the lever 19 moved clockwise. During this time, the roller lever 18 is guided along the curved surface 20 of the cam track 17 and the support 15 is raised. Upon reaching the detent 21, the roller lever 18 snaps into the detent 21 (FIG. 2). The support 15 and deflection beam 3 are thus in an uppermost position (FIG. 2). The reverse procedure is followed when the deflection beam 3 is to be lowered.

What is claimed is:

1. In a loom, the combination comprising
a frame having means for mounting a warp beam thereon;
a tensioning beam mounted on said frame for imparting tension to a plurality of warp threads passing from a warp beam;
a deflection beam mounted on said frame upstream of said tensioning beam relative to the warp threads passing from the warp beam; and
means mounted on said frame for moving said deflection beam to adjust said deflection beam independently relative to said tensioning beam.

2. The combination as set forth in claim 1 which further comprises a support arm having said tensioning beam and said deflection beam mounted thereon in common.

3. The combination as set forth in claim 2 wherein said means includes a support having said deflection beam mounted thereon, said support being selectively rotatably mounted relative to said support arm.

4. The combination as set forth in claim 1 which further comprises a support beam mounted on said frame; and wherein said means includes a support secured to said support beam for selective rotation relative thereto and having said deflection beam mounted thereon, a cam track on said support, a roller lever pivotally mounted on a fixed axis relative to said support and riding on said cam track, and a lever secured to said roller lever for pivoting of said roller lever about said fixed axis to selectively raise and lower said support and said deflection beam thereon.

5. In a loom, the combination comprising
a frame having means for mounting a warp beam thereon;
a support arm mounted on said frame;
a tensioning beam mounted on said support arm for imparting tension to a plurality of warp threads passing from a warp beam;
a deflection beam mounted on said support arm upstream of said tensioning beam relative to the warp threads passing from the warp beam; and
means for adjusting said deflection beam relative to said tensioning beam, said means including a support having said deflection beam mounted thereon and being selectively rotatably mounted relative to said support arm, a cam track on said support and a movably mounted roller lever for movement along said track to raise and lower said support releative to said support arm.

6. The combination as set forth in claim 5 wherein said track has a curved surface shaped to allow a constant torque on said lever during a raising and lowering of said support.

7. In a loom, the combination comprising
a frame having means for mounting a warp beam thereon;
a support arm mounted on said frame;
a support beam mounted on said support arm;
a tensioning beam mounted on said support beam for imparting tension to a plurality of warp threads passing from a warp beam;
a deflection beam upstream of said tensioning beam relative to the warp threads passing from the warp beam; and
means for adjusting said deflection beam relative to said tensioning beam, said means including a support secured to said support beam for relative rotation thereto, said support having said deflection beam mounted thereon and a fulcrum coincident with the axis of said support beam.

8. The combination as set forth in claim 7 which further comprises a detachable clamp connection selectively securing said support to said support beam.

9. The combination as set forth in claim 7 wherein said means further includes a cam track on said support and a movably mounted roller lever for movement along said track to raise and lower said support relative to said support arm.

10. The combination as set forth in claim 9 wherein said track has a curved surface shaped to allow a constant torque on said lever during a raising and lowering of said support.

11. In a loom, the combination comprising
a frame;
a wrap stop motion mounted on said frame;
a warp beam mounted on said frame for supplying warp threads to said warp stop motion;

a tensioning beam mounted on said frame above the axis of said warp beam and between said warp beam and said stop motion for imparting tension to a plurality of warp threads passing from said warp beam to said stop motion;

a deflection beam mounted on said frame above said axis of said warp beam and between said warp beam and said tensioning beam to deflect the warp threads passing from said warp beam to said stop motion; and means mounted on said frame for moving said deflection beam to adjust said deflection beam independently relative to said tensioning beam and permit raising of said deflection beam away from said axis of said warp beam without raising said tensioning beam.

* * * * *